United States Patent [19]

D'Gerolamo

[11] 4,425,784

[45] Jan. 17, 1984

[54] ANGLE INDICATOR ATTACHABLE TO TUBE BENDERS AND THE LIKE

[76] Inventor: Frank D'Gerolamo, 2730 Bartlett St., Baton Rouge, La. 70805

[21] Appl. No.: 400,745

[22] Filed: Jul. 22, 1982

[51] Int. Cl.[3] ..... B21D 7/14; B21C 51/00

[52] U.S. Cl. ..... 72/459; 33/334; 33/370; 72/36

[58] Field of Search ..... 72/459, 458, 457, 32, 72/33, 34, 36, 31; 33/370, 371, 372, 373, 379, 334, 174 N

[56] References Cited

U.S. PATENT DOCUMENTS

| | | | |
|---|---|---|---|
| 2,932,225 | 4/1960 | Gardner | 72/459 |
| 2,953,048 | 9/1960 | Brown | 72/459 |
| 3,063,314 | 11/1962 | Benfield | 72/458 |
| 3,253,441 | 5/1966 | Benfield | 72/31 |
| 3,718,018 | 2/1973 | Benfield | 72/458 |
| 3,826,013 | 7/1974 | Baher | 33/373 |
| 3,906,778 | 9/1975 | Crouse | 72/459 |
| 3,978,591 | 9/1976 | Jaaskelainen | 33/373 |
| 4,009,602 | 3/1977 | Linquist | 72/459 |
| 4,052,881 | 10/1977 | Mount | 72/459 |
| 4,154,001 | 5/1979 | Serafin | 33/373 |
| 4,321,820 | 3/1982 | Nason | 72/36 |

*Primary Examiner*—Gene P. Crosby
*Attorney, Agent, or Firm*—William D. Kiesel

[57] ABSTRACT

A device for indicating the angular movement of a tube bender and the like is disclosed comprising a plate assembly having an alignment groove for attaching, in desired position, the plate to the elongated handle of the tube bender, and wherein the plate assembly has an arcuate spirit level with an angular movement position indicator air bubble inside and has angle marked surface adjacent the arcuate spirit level.

3 Claims, 4 Drawing Figures

ANGLE INDICATOR ATTACHABLE TO TUBE BENDERS AND THE LIKE

BACKGROUND OF THE INVENTION

1. Field of the Invention

This invention relates in general to position indicating devices and more particularly to position indicating devices for use with hand operated tube benders and the like.

2. Prior Art

The need to field fabricate thin walled electrical conduit, small watering lines, etc. of varying lengths and shapes led to the development of the tube benders. However, the principal problem with the tube benders has been the inability to accurately duplicate bends. To solve this difficulty, a whole range of angles indicating means have been incorporated in tool benders. For example, Gardner U.S. Pat. No. 2,932,225 issued Apr. 12, 1960 and entitled "Tubing Bending Device" discloses an adjustable straight spirit level attached to the bending head of the bender. Benfield et al U.S. Pat. No. 3,063,314 issued Nov. 13, 1962 and entitled "Pipe and Tube Bender" simply employed markings on the bending head, while Benfield U.S. Pat. No. 3,253,441 issued May 31, 1966 and entitled "Pipe Bending Tool" discloses a free swinging pointer attached to the shank of the tube bender that aligns with markings on the arcuate shaped bending head. In another alternate Linquist U.S. Pat. No. 4,009,602 issued Mar. 1, 1977 and entitled "Tube Bending Tool with Angle Sighting Means" utilizes a sighting tube attached to the bending head to help the operator see the angle markings on the bending head. The difficulties with all of the above prior art devices are that they depend upon operator sightings from a distance of four or five feet. This is simply to far for accurate measurement during field use since the markings on the bending head are so small. In one alternative, Brown U.S. Pat. No. 2,953,048 issued Sept. 20, 1960 and entitled "Angle-Indicating Attachment For A Pipe Bender" utilized an arcuate angle indicating means whose pointer movement is controlled by a linkage means attached to or positioned on the pipe being bent. Such a device could be attached closer to the operator on the bender handle, but in addition to being more complex and thus more likely to be broken during field use it is not readily adaptable to bending short pieces of pipe. Because of the difficulty in designing an accurate tube bender more recent developments have centered around tube benders where the operator pre-sets a desired angle by mechanical means. Examples of such devices can be seen in Benfield U.S. Pat. No. 3,718,018 issued Feb. 27, 1973 and entitled "Pipe Bending Tool"; Crouse U.S. Pat. No. 3,906,778 issued Sept. 23, 1975 and entitled "Pipe and Tube Bender"; Mount U.S. Pat. No. 4,052,881 issued Oct. 11, 1977 and entitled "Improved Process for Providing Offset Bends of the Correct Dimension in Pipe and the Like" and Nason U.S. Pat. No. 4,321,820 issued Mar. 30, 1982 and entitled "Pipe-Bending Tool." While these tools work fine when the exact angle of bend is known, prior to bending they become more cumbersome to use when the exact angle is not known, as more than one adjustment must be made. In addition, these tools are more complex and thus expensive. Thus, in spite of the extensive research and development there still exists the need for a simple tube bender that allows variable accurate tube bending in the field.

SUMMARY OF THE INVENTION

Therefore, it is an object of this invention to provide an angle indicator attachable to a tube bender which allows quick, easy and accurate readings of the angle that the tube has been built.

Another object of this invention is to provide an angle indicator that can be attached to any field use tube bender.

Other objects and advantages of this invention will become apparent from the ensuing descriptions of the invention.

Accordingly, an angle indicator is provided comprising an arcuate shaped spirit level fixedly attached to a support base having alignment means for correctly positioning the base on the bender handle, the base having angle indicating markings adjacent the spirit level.

PREFERRED EMBODIMENTS OF THE INVENTION

Figure 1:
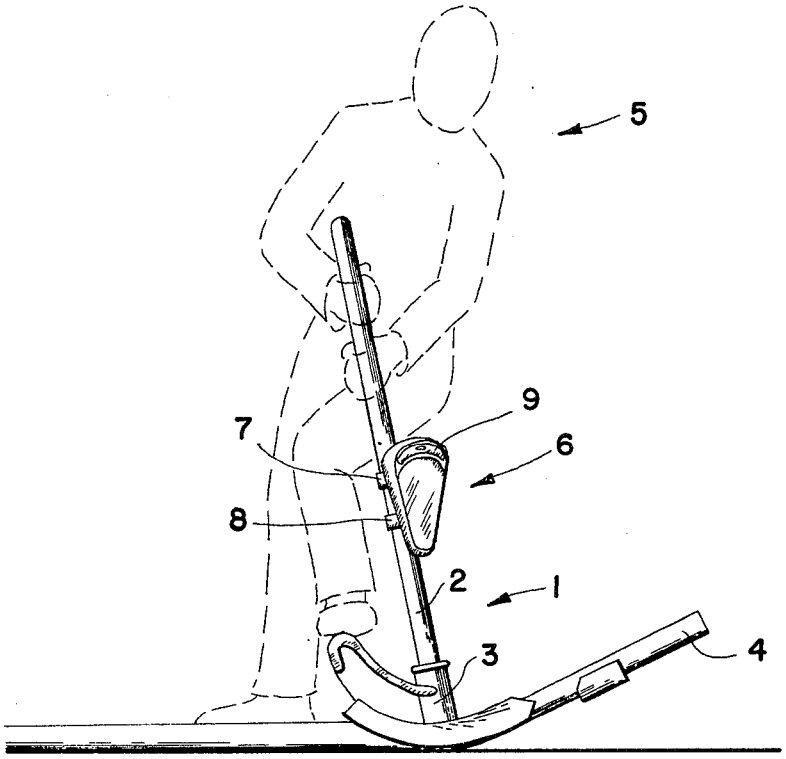
FIG. 1 is a three-dimensional view of a preferred embodiment of the angle indicator of this invention attached to the elongated handle of a conventional pipe bender.

Turning now to FIG. 1, a conventional tube bender 1 having an elongated handle 2 and bending head 3 is shown with pipe 4 positioned in bender 1 and being bent by operator 5. In this embodiment angle indicator 6 is attached to handle 2 by straps 7 and 8 so that spirit level 9 can be easily seen.

Figure 2:
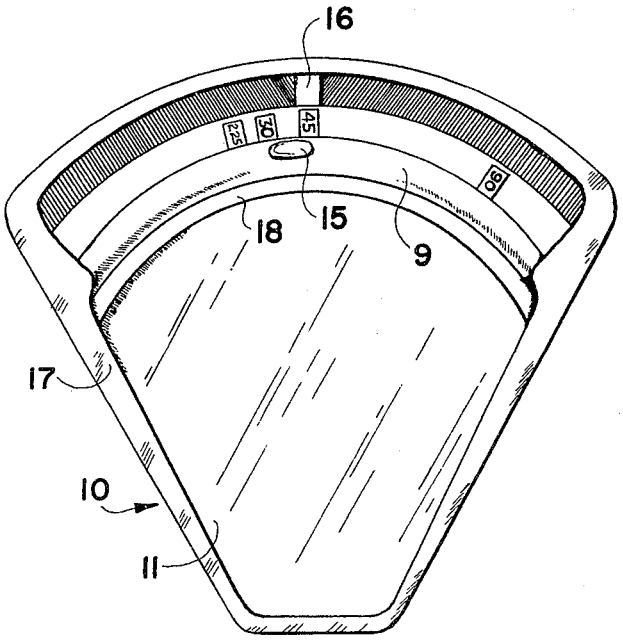
FIG. 2 is a front view of the angle indicator.
Figure 4:
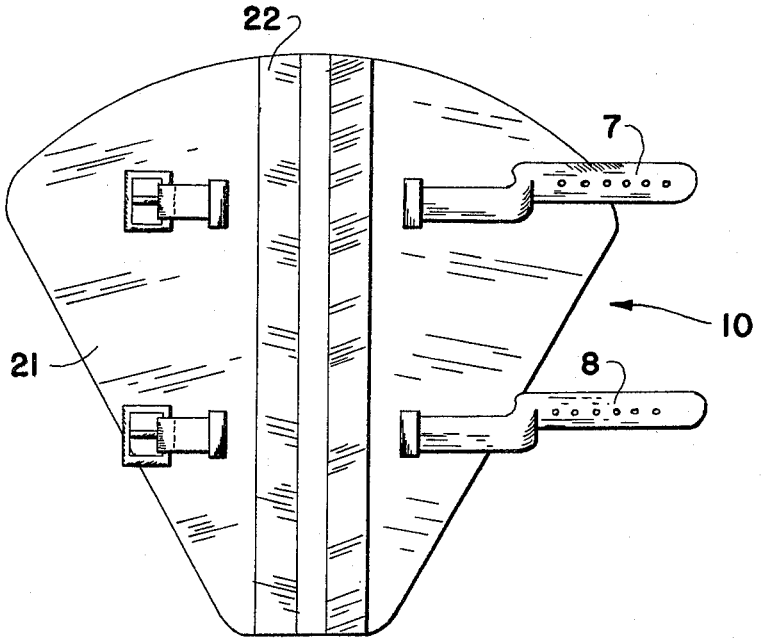
FIG. 4 is a back view of a preferred embodiments of the alignment means of the angle indicator.
Figure 3:
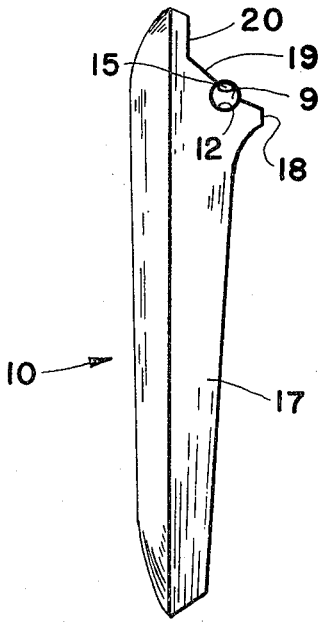
FIG. 3 is a side view of the angle indicator.

Examining now FIGS. 2–4 angle indicator 6 is shown having a support base 10 provided on its front side 11 with an arcuate groove 12 shaped to allow spirit level 9 to be fixed therein. Adjacent to spirit level 9 is a flat arcuate shaped surface 13 on which are placed the angle indicating marking 14. When utilizing angle indicator 6 with conventional field use tube benders the midpoint of spirit level 9 is parallel with handle 2 and indicates a tube bend of 45° when air bubble 15 is positioned at the mid-point 16.

In a preferred embodiment, side 11 has sloped beveled edges 17 to form ridge 18 which protects spirit level 9 from breaking when the tube bender is dropped on the ground. To further prevent breakage surface 11 has a flat top areas 19 and 20 extending out at angles from spirit level 9 a distance sufficient so that the exposed portion of spirit level will not strike the ground.

Looking particularly at FIG. 4, the back side 21 is provided with a vertical straight groove 22 that is perpendicular to mid-point 16 and is shaped to fit partially around handle 2. In a particularly preferred embodiment, groove 22 is lined with magnetic tape for quick attachment to certain metal handles. In other cases straps 7 and 8 can be used to secure angle indicator 6 to handle 2.

The exact positioning of indicator 6 on handle 2 can vary from operator to operator but it is preferred to place it as close to the top of handle 2 as is possible and still allow ease in use of tube bender 1.

There are, of course, many alternate embodiments not specifically shown, but which are intended to be included within the scope of the invention as defined by the following claims.

What I claim is:

1. An angle indicator for use with a pipe heater having an elongated handle or like device comprising: an arcuate-shaped spirit level fixedly attached to a support base having an arcuate shaped groove of depth and shape sufficient for said spirit level to fit in said groove and having a straight groove running vertically on one side of said base perpendicular to the center of said spirit level on the opposite side of said base, said base having angle indicating markings adjacent said spirit level.

2. An angle indicator according to claim 1 wherein magnetic tape is attached in said straight groove.

3. An angle indicator according to claim 1 wherein adjustable securing straps are attached across said straight groove to tighten said base to said elongated handle.

* * * * *

UNITED STATES PATENT AND TRADEMARK OFFICE

CERTIFICATE OF CORRECTION

PATENT NO. : 4,425,784

DATED : January 17, 1984

INVENTOR(S) : Frank D'Gerolamo

It is certified that error appears in the above-identified patent and that said Letters Patent is hereby corrected as shown below:

Column 3, Line 6, change the word "heater" to --bender--.

Signed and Sealed this

*Thirtieth* Day of *April 1985*

[SEAL]

*Attest:*

DONALD J. QUIGG

*Attesting Officer* *Acting Commissioner of Patents and Trademarks*